US009320321B2

(12) United States Patent
Robinson, Jr.

(10) Patent No.: US 9,320,321 B2
(45) Date of Patent: Apr. 26, 2016

(54) DECORATIVE SHOES AND METHODS FOR MAKING THE SAME

(71) Applicant: Carl Robinson, Jr., Monroe, LA (US)

(72) Inventor: Carl Robinson, Jr., Monroe, LA (US)

( * ) Notice: Subject to any disclaimer, the term of this patent is extended or adjusted under 35 U.S.C. 154(b) by 0 days.

(21) Appl. No.: 14/201,596

(22) Filed: Mar. 7, 2014

(65) Prior Publication Data

US 2015/0250263 A1 Sep. 10, 2015

(51) Int. Cl.
*A43B 23/24* (2006.01)
*A43B 23/02* (2006.01)

(52) U.S. Cl.
CPC ..... *A43B 23/24* (2013.01); *A43B 23/0205* (2013.01)

(58) Field of Classification Search
CPC ..... A43B 1/007; A43B 1/009; A43B 1/0027; A43B 1/0036; A43B 1/072; A43B 23/0235; A43B 23/026; A43B 1/0072; A43B 3/0078; A43B 23/24
USPC ..... 36/84, 136, 137, 119.1, 45, 46.5, 36/48–49, 3 A, 8.3, 128, 129, 98, 8.1
See application file for complete search history.

(56) References Cited

U.S. PATENT DOCUMENTS

| | | | | | |
|---|---|---|---|---|---|
| 1,977,995 | A | | 3/1934 | Morali | |
| 1,958,135 | A | * | 5/1934 | Dunbar et al. | 36/3 A |
| 2,001,962 | A | * | 5/1935 | Kantrow | 428/48 |
| D118,141 | S | * | 12/1939 | Weyand | D2/973 |
| D119,664 | S | * | 3/1940 | Greenblatt | D2/942 |
| 2,298,152 | A | | 3/1941 | O'Russa | |
| 2,271,595 | A | | 2/1942 | Langendorf | |
| 3,526,568 | A | * | 9/1970 | Martello et al. | 428/337 |
| 4,837,960 | A | * | 6/1989 | Skaja | 40/636 |
| 5,367,795 | A | * | 11/1994 | Iverson et al. | 36/136 |
| 5,572,817 | A | * | 11/1996 | Chien | 40/544 |
| 5,809,669 | A | * | 9/1998 | Hage et al. | 36/127 |
| 5,896,683 | A | * | 4/1999 | Foxen et al. | 36/89 |

(Continued)

FOREIGN PATENT DOCUMENTS

WO WO2013000051 A3 1/2013

OTHER PUBLICATIONS

Consolidatedlabel.com [online], "Clear Labels, Let Your Labels Do the Talking", URL http://www.consolidatedlabel.com/capabilities/label-material-types/clear-labels/, retrieved from the Internet on Nov. 13, 2014 (5 pages).

(Continued)

*Primary Examiner* — Robert J Hicks
*Assistant Examiner* — Timothy K Trieu
(74) *Attorney, Agent, or Firm* — Fish & Richardson P.C.

(57) ABSTRACT

A decorative shoe includes a sole, an upper attached to the sole, in which the upper has an interior lining, a decorative outer layer fixed to the interior lining, and a decorative semi-transparent pattern film fixed to a surface of the outer layer. The decorative outer layer is composed of a contiguous transparent or translucent plastic material, in which the surface of the outer layer includes a first multiple of raised, close-packed jewel-shaped elements. The decorative semitransparent pattern film is configured to simulate an appearance of a plurality of jewels. Each jewel-shaped element also has a short axis and multiple boundaries normal to the short axis, in which the multiple boundaries enclose one or more facets on a face of the jewel-shaped element. The pattern film forms an outer surface of the shoe and is configured to partially reflect or scatter incident light.

24 Claims, 20 Drawing Sheets

(56) References Cited

U.S. PATENT DOCUMENTS

| | | | | |
|---|---|---|---|---|
| 5,930,921 | A * | 8/1999 | Sorofman et al. | 36/137 |
| 6,112,437 | A * | 9/2000 | Lovitt | 36/137 |
| 6,443,590 | B1 * | 9/2002 | Lovitt | 362/103 |
| 6,802,140 | B2 * | 10/2004 | Aslanides | 36/136 |
| 6,811,734 | B2 | 11/2004 | Kelley | |
| 7,155,846 | B2 * | 1/2007 | Alfaro et al. | 36/136 |
| 7,818,898 | B1 | 10/2010 | Orengo | |
| 7,854,077 | B1 * | 12/2010 | Jauregui | 36/136 |
| 8,132,340 | B2 * | 3/2012 | Meschter | 36/45 |
| 2002/0184791 | A1 * | 12/2002 | Ko | 36/8.1 |
| 2003/0221244 | A1 * | 12/2003 | Liddell | 2/244 |
| 2004/0068778 | A1 * | 4/2004 | Van Veghel et al. | 2/244 |
| 2004/0088888 | A1 * | 5/2004 | Johnston | 36/133 |
| 2004/0107601 | A1 * | 6/2004 | Schmid | 36/28 |
| 2004/0172855 | A1 * | 9/2004 | Aslanides | 36/136 |
| 2004/0177532 | A1 * | 9/2004 | Lawrence | 36/136 |
| 2004/0255490 | A1 | 12/2004 | Wan et al. | |
| 2005/0207138 | A1 * | 9/2005 | Cheung | 362/84 |
| 2005/0268497 | A1 * | 12/2005 | Alfaro et al. | 36/136 |
| 2006/0130367 | A1 * | 6/2006 | Liu | 36/55 |
| 2008/0189830 | A1 * | 8/2008 | Egglesfield | 2/244 |
| 2009/0183392 | A1 * | 7/2009 | Shane | 36/97 |
| 2010/0251491 | A1 * | 10/2010 | Dojan et al. | 12/142 R |
| 2013/0091620 | A1 * | 4/2013 | Randolph | 2/244 |
| 2013/0276334 | A1 * | 10/2013 | Bellone et al. | 36/136 |
| 2013/0303041 | A1 * | 11/2013 | Kim | 442/1 |
| 2014/0250734 | A1 | 9/2014 | Zheng | |

OTHER PUBLICATIONS

Onlinelabels.com [online], Choosing the Right Clear Label, URL http://www.onlinelabels.com/articles/choosing-the-right-clear-label.htm, retrieved from the Internet on Nov. 13, 2014 (3 pages).

International Search Report and Written Opinion for Intl. App. No. PCT/US 15/19483, mailed Aug. 14, 2015 (12 pages).

* cited by examiner

DECORATIVE SHOES AND METHODS FOR MAKING THE SAME

TECHNICAL FIELD

The present disclosure relates to decorative shoes and methods of making the same.

BACKGROUND

As with various pieces of clothing, shoes are often decorated as a way of expressing one's personality, as well as drawing the attention of others. One technique for decorating shoes is to accent the shoe with multiple separate jewel-shaped objects or charms. In certain cases, such jewel-shaped objects only cover relatively small portions of the shoe and may be easily broken off, leaving unsightly gaps where the object used to be located. In addition, placing the objects on the shoe may be time-consuming because each object needs to be fixed to the shoe separately. In some cases, the irregular shapes of the jewel-shaped objects preclude close-packing of the objects on the shoe. As a result, placement of the objects may be limited to only certain areas in which the objects can fit.

SUMMARY

The present disclosure relates to decorative shoes, and methods for making the same, in which an outer part of the shoe if formed by a layer of contiguous material having jewel-shaped features configured to simulate the appearance of multiple jewels, such as diamonds. Because the jewel-shaped features are constructed as part of the contiguous layer, the occurrence of gaps caused by charms falling off can be avoided. By forming the jewel-shaped features on a contiguous material, the features can be close-packed, and thus placed in various regions around the shoe. Additionally, one or more light sources can be embedded beneath the contiguous layer to enhance the brilliance of the jewel-shaped features.

In general, the subject matter of the present disclosure can be embodied in decorative shoes that include a sole, an upper attached to the sole, in which the upper has an interior lining, a decorative outer layer fixed to the interior lining, and a decorative semi-transparent pattern film fixed to a surface of the outer layer. The decorative outer layer is composed of a contiguous transparent or translucent plastic material, in which a surface of the outer layer includes a first multiple of raised, close-packed jewel-shaped elements. Each jewel-shaped element has a short axis and multiple boundaries normal to the short axis. The decorative semi-transparent film is configured to simulate an appearance of a plurality of jewels. The multiple boundaries enclose one or more facets on a face of the jewel-shaped element. The pattern film forms an outer surface of the shoe and is configured to partially reflect or scatter incident light.

The decorative shoes can include one or more of the following features. For example, in some implementations, the jewel-shaped elements are rhomboids.

In some implementations, the outer layer exhibits a tint of at least one color.

In some implementations, the decorative pattern layer includes a second multiple of close-packed jewel-shaped elements. Two or more jewel-shaped elements of the second multiple of close-packed jewel-shaped elements can be different colors. At least one of the jewel-shaped elements of the second multiple of close-packed jewel-shaped elements exhibits multiple different colors.

In some implementations, each of the first multiple of close-packed jewel-shaped elements is approximately equal in size.

In some implementations, one or more of the first multiple of jewel-shaped elements have at least two boundaries of differing lengths.

In some implementations, each boundary of each jewel-shaped element is greater than about ¼mm and less than about 76 mm.

In some implementations, the upper further includes a reflective layer between the outer layer and the interior lining or between the outer layer and the pattern film. The reflective layer can include a metal foil.

In some implementations, the outer layer is polymethyl methacrylate (PMMA).

In some implementations, the surface of the outer layer comprises an elongated mesa-like protrusion having a substantially planar top face. The elongated mesa-like protrusion can have a length between about 1 to 12 inches, a width between about 0.5 to 3 inches, and a protrusion thickness between about 0.1 to 0.5 inches.

In some implementations, the outer layer covers an entire first side of the upper, in which the first side faces outward from an interior region of the shoe.

In some implementations, the face of each jewel-shaped element is smooth.

In some implementations, each jewel-shaped element in the first multiple of close-packed jewel-shaped elements includes multiple facets, each facet being raised at an oblique angle from at least one other facet in the jewel-shaped element.

In some implementations, the boundaries of each jewel-shaped element are grooves.

In some implementations, the decorative shoes further include power sources, and one or more light emitting devices electrically coupled to the power sources and arranged between the interior lining and the outer layer. The one or more light emitting devices can include a white light emitting diode. The power sources can be embedded in the sole of the shoes. The decorative shoe further can include one or more housings, in which the one or more light emitting devices are embedded in the one or more respective housings, and wherein the interior lining forms sidewalls to the housings, and the outer layer forms a cover to the one or more housings.

In some implementations, an outer surface of the outer layer is smooth, the entire outer surface of the outer layer facing away from an interior region of the shoe.

In some implementations, the decorative outer layer further includes a fabric attached to the decorative outer layer and forming a portion of the shoe exterior, in which the fabric is selected from the group consisting of natural leather, artificial leather, composite leather, cotton, polyester, rubber, fake fur, and combinations thereof.

In another aspect, the subject matter of the present disclosure can be embodied in decorative shoes that include a sole, an upper attached to the sole, in which the upper includes an interior lining, a decorative outer layer fixed to the interior lining, the decorative outer layer being composed of a contiguous transparent or translucent plastic material. A surface of the outer layer includes a first multiple of close-packed raised jewel-shaped elements, in which each jewel-shaped element is configured to simulate an appearance of a jewel. Dach jewel-shaped element in the first multiple of close-packed jewel-shaped elements has a short axis and multiple boundaries normal to the short axis, in which the multiple boundaries enclose multiple facets on a face of the jewel-shaped element. Each facet is raised at an oblique angle from at least one other facet in the jewel-shaped element, and each jewel-shaped element is configured to partially reflect or scatter incident light.

The details of one or more implementations are set forth in the accompanying drawings and the description below. Other aspects, features, and advantages will be apparent from the description and drawings, and from the claims.

DETAILED DESCRIPTION

Figure 1:
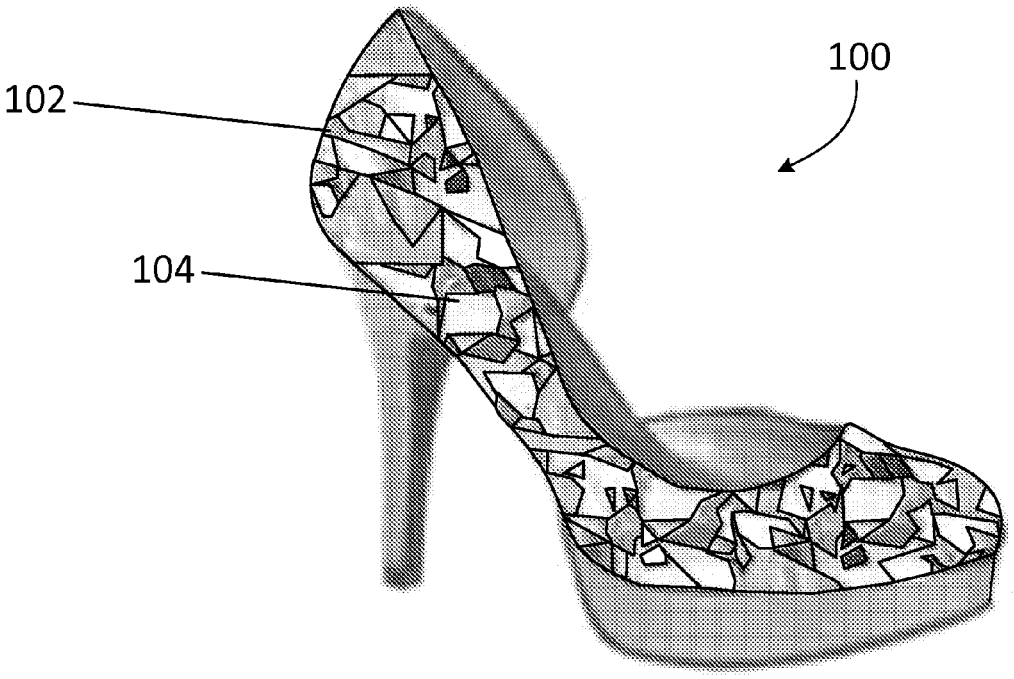
FIG. 1 is a schematic illustrating an example of a shoe having a decorative outer layer.

FIG. 1 is a schematic illustrating a perspective view of an example of a shoe 100 having an outer layer 102 that includes an array of decorative jewel-shaped elements 104. That is, each element 104 is configured to simulate the appearance of a jewel or gemstone such as a diamond, ruby, sapphire, emerald, garnet, topaz, among others that have multiple facets arranged obliquely with respect to one another. For example, each element 104 may include multiple grooves defining the element's boundary, and is configured to be translucent or transparent, and have relatively high brilliance/reflectance. Furthermore, the elements 104 are formed together as part of a single contiguous outer layer 102, such that no single object or objects can easily detach from the shoe 100.

Figure 2:
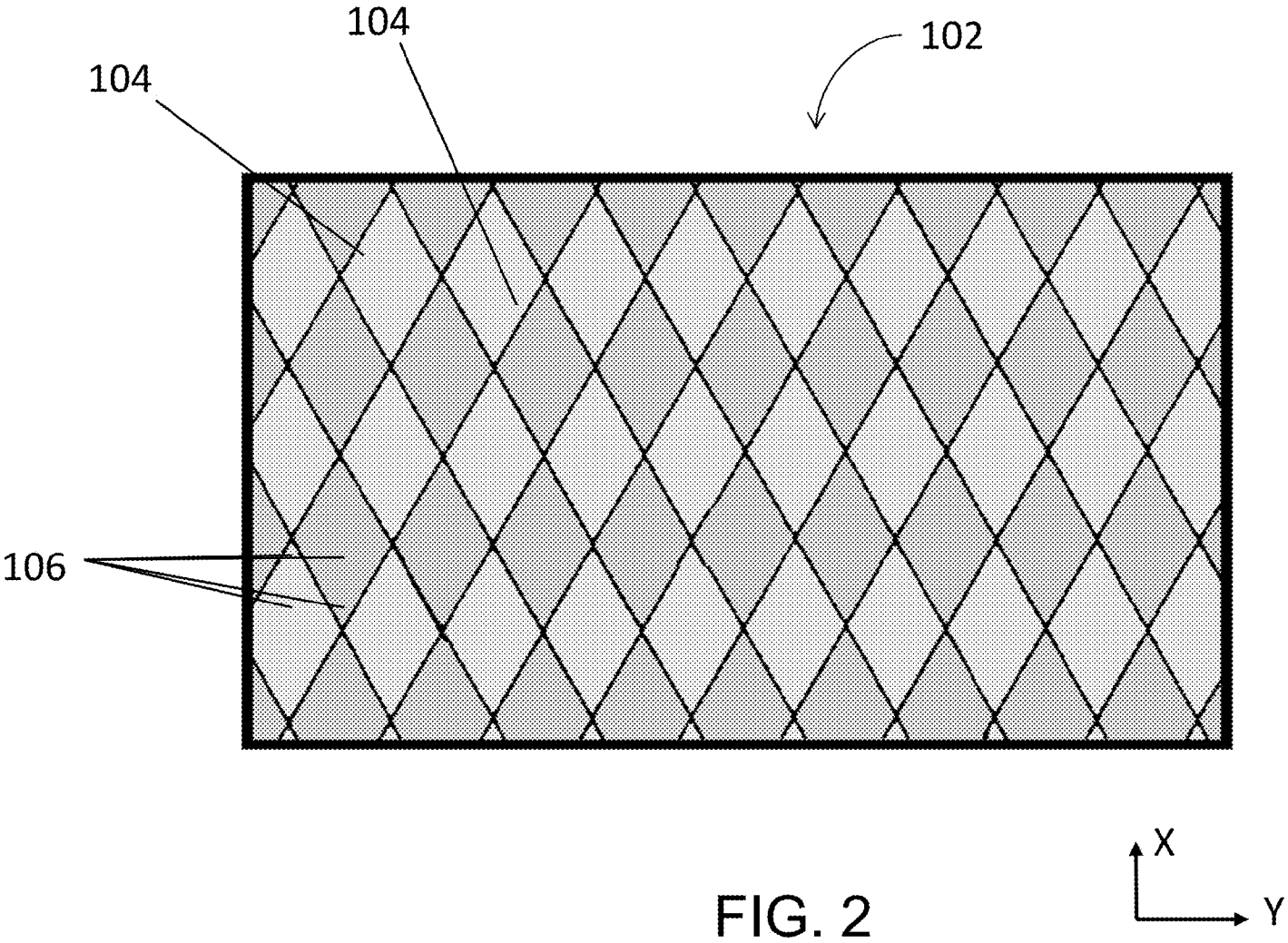
FIG. 2 is a top view of jewel-shaped elements formed on a decorative outer layer.

FIG. 2 is a schematic illustrating a two-dimensional view of a portion of outer layer 102 containing the jewel-shaped elements 104. A jewel-shaped element 104 is configured to have a polygon shape with a short axis equal to the thickness of the outer layer 102 (i.e., into the page for the example shown in FIG. 2) and an upper face enclosed by three or more boundaries 106 extending along directions that are normal to the short axis. Each boundary of a jewel-shaped element forms an oblique angle with an adjacent boundary of the jewel-shaped element and follows the curvature of the outer layer 102 as defined by the shoe shape. The region enclosed by the boundaries 106 of each jewel-shaped element includes one or more facets.

In the example shown in FIG. 2, the jewel-shaped elements 104 each include 4 boundaries 106. In some implementations, the elements 104 are configured to appear like diamonds or rhombuses, e.g., a quadrilateral having sides of approximately equal length, and in which the diagonals are substantially perpendicular and bisect each other. Alternatively, and in contrast to the pattern shown in FIG. 2, the sides of the elements 104 can have different lengths. Furthermore, the elements 104 are close-packed such that there is little or no distance between adjacent elements 104. Though the diamond-shaped elements 104 of FIG. 2 appear in a repeating pattern, in some cases the elements 104 may be arranged such that there is no recognizable repeating pattern, e.g., the elements 104 have different sizes and are arranged in a non-repeating pattern (e.g., randomly). Each boundary 106 of a polygon shaped element 104 has a length in the range of about ¼mm to about 76 mm. For example, the length can be about 1 mm, 5 mm, 10 mm, 20 mm, 30 mm, 40 mm, 50 mm, or 60 mm. Optionally, the boundaries 106 of each element 104 correspond to thin grooves or channels extending within the surface of the outer layer 102, such that the jewel-shaped elements 104 are effectively raised features on the outer layer surface. For example, the grooves may be formed in the layer 102 as a result of a molding process. The thickness of the grooves is shallow relative to the thickness of the outer layer 102. For example, the grooves 10 can have a depth in the range of about 0.5 mm to about 0.9 mm, such as 0.76 mm, whereas the outer layer has a thickness that is greater than the groove depth. The range of thicknesses for the outer layer 102 can be between about 1 mm to about 30 mm, such as 3.5 mm.

The outer layer 102 is formed from a material suitable to molding processes such as injection molding, compression molding and extrusion. For example, the material forming the outer layer 102 can include polymethylmethacrylate (PMMA), sometimes referred to by the commercial name of "Lucite," "Plexiglass," "Acrylite," or "Perspex." Preferably, the material forming the outer layer 102 is transparent or translucent to visible light (i.e., light in the wavelength range between infrared and ultraviolet). However, in some implementations, the material is also tinted to exhibit a particular color. For example, the layer 102 may be tinted red, blue, green, purple, among other colors. The outer layer 102 can be fixed to an interior lining of the shoe. The interior lining can include any suitable lining for a shoe, such as natural leather, artificial leather, composite leather, cotton, or polyester, among others.

In some implementations, the outer surface of the outer layer 102 is smooth. That is, the area within each of the elements 104 is planar with little variation in height (e.g., less than about 0.05 mm in average roughness, less than about 0.01 mm in roughness, less than about 0.001 mm in roughness, or as available with commercially obtained PMMA), though the outer layer 102 may be associated with some curvature to allow for conforming to the shape of the shoe.

Various techniques can be used to enhance the reflectance of the elements 104 so that they are not dull in appearance or so they appear jewel-shaped (e.g., having high brilliance). For example, the outer surface of the outer layer 102 may be coated with a semitransparent film. In some cases, the semitransparent film can include, for example, a thin film of material containing a printed image of a "diamond overspread pattern." The diamond overspread pattern includes an image of randomly arranged and differently sized diamond shapes, each of which is partially reflective to incident light. The diamond shapes may be similar in size and shape as the jewel-shaped elements 104 formed on the outer layer 102. The shapes formed on the semitransparent film may have the same close-packed design of jewel-shaped elements as the arrangement of the jewel-shaped elements 104 on the outer layer 102. For example, the shapes formed on the semitransparent film may have the same size, shape, and arrangement as the jewel-shaped elements 104.

Figure 3A:
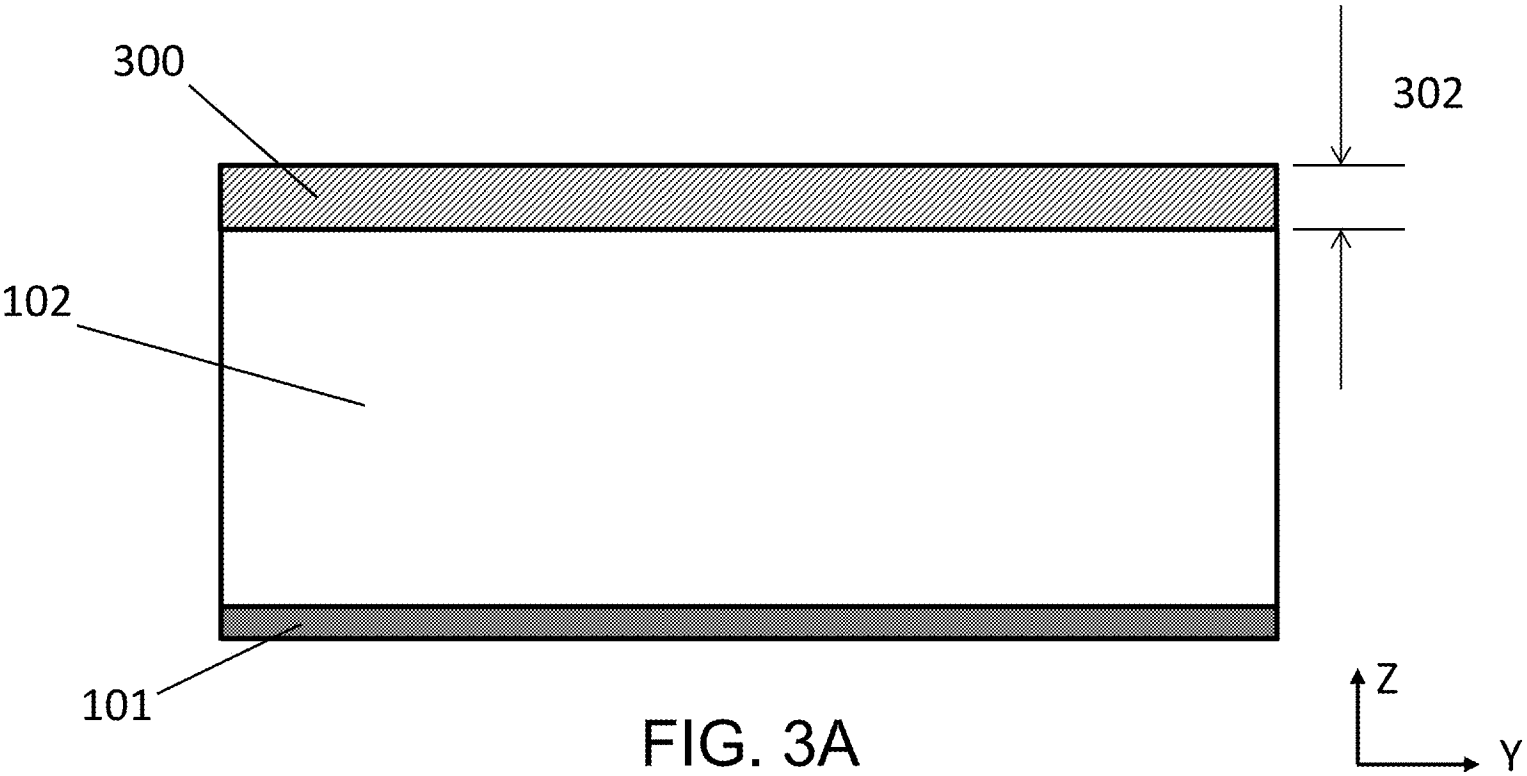
FIG. 3A is a schematic illustrating a side view of a decorative outer layer on which a semitransparent film is formed.

FIG. 3A is a side view of an example of an outer layer 102 on which a thin semitransparent film 300 is formed. The outer layer 102 is affixed to an interior lining 101 of the shoe. The outer layer 102 can be fixed to the interior lining 101 using an adhesive, such as glue. The semitransparent film 300 may be fixed to the surface of the outer layer 102 using an adhesive, such as epoxy or glue, or may be applied using a heat press. For example, the thickness 302 of the semitransparent film 300 can be in the range of about 0.15 mm to about 2 mm, such as 1.59 mm or 0.229 mm. The pattern on film 300 is semitransparent to allow at least some incident light to pass through the patterns. For example, the pattern can be configured to allow between about 10% and about 80% of light to pass through, such as at least 10% of incident light to pass through, at least 20% of incident light to pass through, at least 30% of incident light to pass through, at least 40% of incident light to pass through, at least 50% of incident light to pass through, at least 60% of incident light to pass through, or at least 70% of incident light to pass through. The overall transparency of the pattern can be set by designing both transparent regions and non-transparent regions. The greater the size of the transparent regions compared to the non-transparent regions, the greater the overall transparency of the pattern will be.

The diamond overspread pattern or other pattern may be designed using a computer or other electronic device configured to execute applicable graphic design software, such as computer aided design (CAD) software. Once the pattern is generated using the graphic design software, the pattern may be applied, e.g., printed, to a transfer sheet. The material printed on the transfer sheet can include, for example, ethylene vinyl acetate (EVA), polyvinyl chloride (PVC) such as Plastisol, or carbon fiber film. Other materials also may be used. The transparency of the material applied to the transfer sheet (e.g., during printing) can be adjusted based on the thickness of the material and/or the design generated using the graphic design software. Typically, the transfer sheet itself is a thin sheet of transparent plastic. With the pattern printed on the transfer sheet, the pattern may be transferred to the outer layer 102 using a heat transfer process. The material constituting the film that forms the diamond overspread pattern or other pattern may also have different colors. For example, the material may have any desired color or combinations of color such as red, green, blue, orange, brown, etc. In some implementations, the different shapes printed on the semitransparent film may have different colors from one or more adjacent printed shapes, such that the semitransparent film exhibits multiple different colored regions, e.g., multiple different colored regions each of which is similar in size and shape to the jewel-shaped elements 104 of the outer layer 102. In some implementations, the shapes printed on the semitransparent film may include multiple colors and/or designs.

Figure 3B:
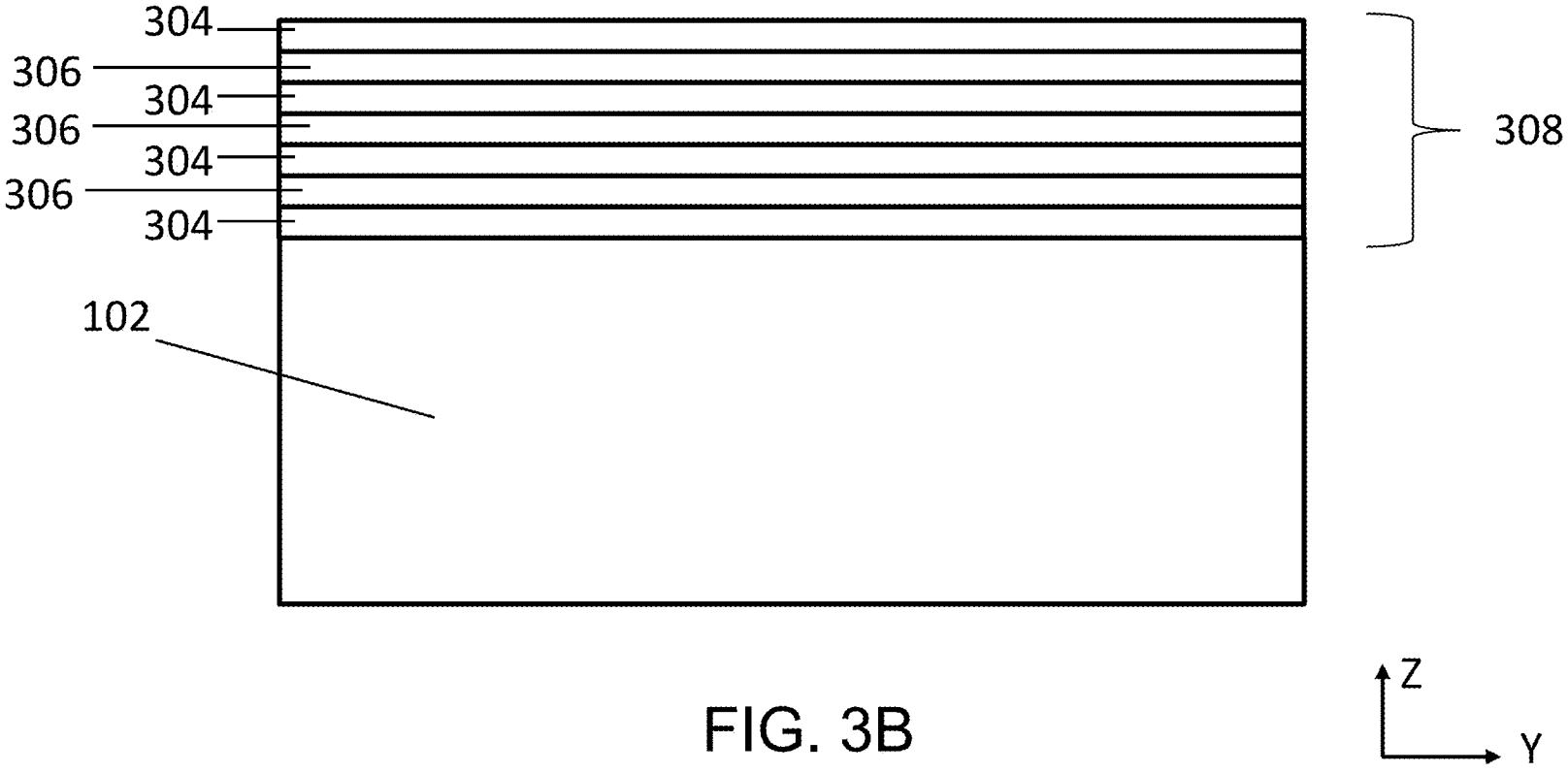
FIG. 3B is a schematic illustrating a side view of a decorative outer layer on which a dielectric mirror stack is formed.

In some cases, the semitransparent transparent film formed on the outer layer 102 includes a reflective dielectric stack. Dielectric stacks, also known as "dielectric mirrors," are a type of mirror composed of multiple thin film layers of dielectric material of alternating refractive index that are formed on another surface or substrate. Dielectric mirrors function based on the interference of light reflected from the different thin film layers of dielectric stack. Simple dielectric mirrors include a stack of thin film layers with a high refractive index interleaved with thin film layers of a low refractive index. The thicknesses of the thin film layers are chosen such that the path-length differences for reflections from different high-index layers are integer multiples of a wavelength for which the mirror is designed. By forming multiple different dielectric stacks on the surface of the outer layer 102, in which each stack is designed to reflect a different wavelength, a broadband stack can be formed that is useful for reflecting a wide range of wavelengths of light, thus enhancing the reflective effects of the outer layer 102 to give it additional brilliance. FIG. 3B is a schematic illustrating a side view of a dielectric stack 308 formed on a surface of outer layer 102. The stack 308 includes first layers 304 having a first refractive index interleaved with second layers 306 having a second refractive index that is higher than the first refractive index. Dielectric mirrors may be manufactured using common thin-film deposition methods, such as physical vapor deposition, chemical vapor deposition, ion beam deposition, molecular beam epitaxy, and sputter deposition of the dielectric stack onto the material constituting the outer layer 102. Once deposited, the material constituting the outer layer can be molded into the corresponding shape for the shoe. Examples of materials for dielectric stacks include magnesium fluoride, silicon dioxide, tantalum pentoxide, zinc sulfide, and titanium dioxide, among others. The thicknesses of the layers in the stack depend on the desired wavelength or range of wavelengths to be reflected. Example thicknesses include 50 nm, 70 nm, 90 nm, 110 nm, 130 nm or 150 nm.

Figure 3C:
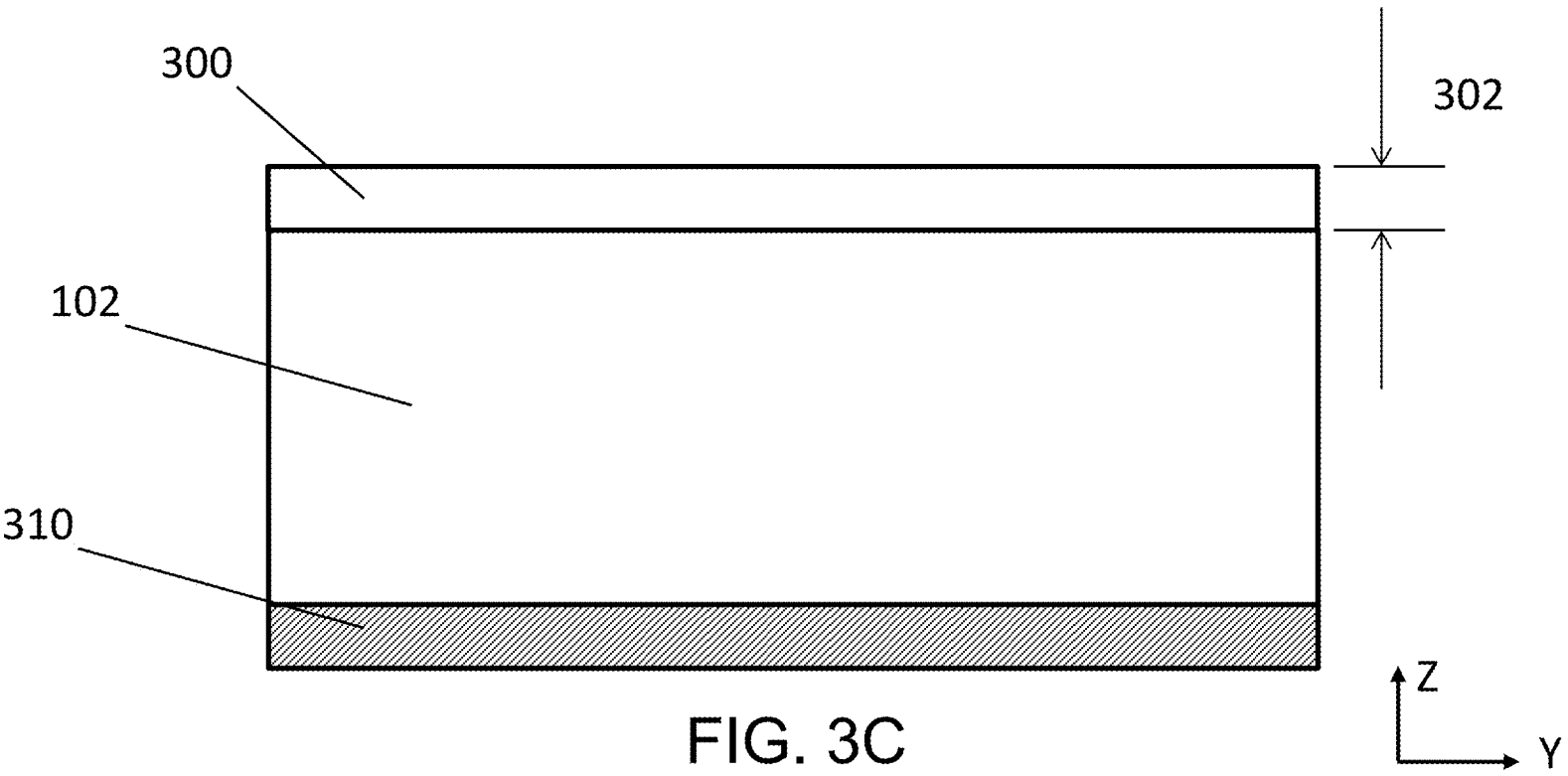
FIG. 3C is a schematic illustrating a side view of a decorative outer layer on which a reflective thin film and a semitransparent film are formed.

In some implementations, the reflectance of the outer layer 102 is enhanced by adding a thin reflective film on the bottom surface of the outer layer 102 (i.e., the surface of outer layer facing in a direction of the interior shoe region). FIG. 3C is a side-view of the outer layer 102 on which a reflective layer 310 is formed. The reflective film 310 can be similar to semitransparent film 300. For example, the reflective film 310 can be a thin sheet of EVA or PVC that is configured to include a pattern highly reflective to incident light (e.g., at least about 85% reflectance) and can be fixed to the bottom surface of outer layer 102 using an adhesive. In some implementations, the reflective film 310 includes a diamond overspread pattern that is composed of randomly arranged and differently sized diamond shapes, each of which is highly reflective to incident light. The film can be composed of a thin plastic sheet coated with thin metal films, such as gold, silver, or aluminum. The reflective pattern can be transferred to the sheet of EVA or PVC using techniques such as, for example, printing reflective material onto the sheet. Alternatively, the reflective material can be deposited using standard techniques such as vapor deposition. The pattern can be formed by removing undesired portions of the reflective material using chemical etching. For example, a mask can be applied to the material surface to cover regions that should not be removed, while the remaining regions that are not covered are exposed to a chemical etchant suitable for etching away the metal film. Other techniques are also possible for forming the pattern on the EVA or PVC sheet. In some implementations, the reflective film 310 can include, for example, aluminum foil.

Figure 4A:
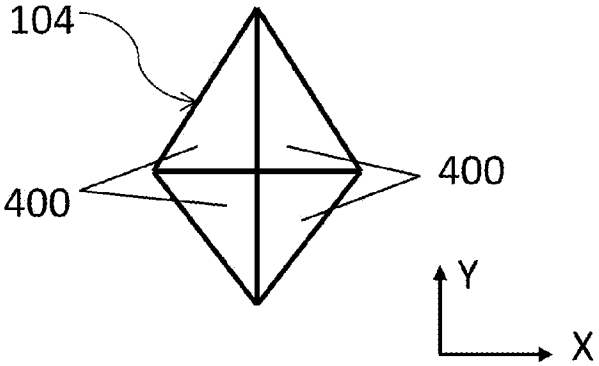
FIGS. 4A-4C are schematics depicting various views of raised facets of a decorative outer layer.
Figure 4B:
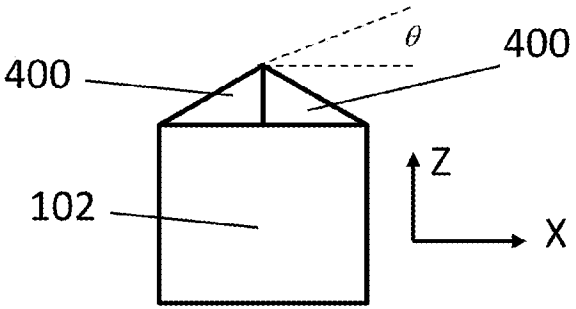
Figure 4C:
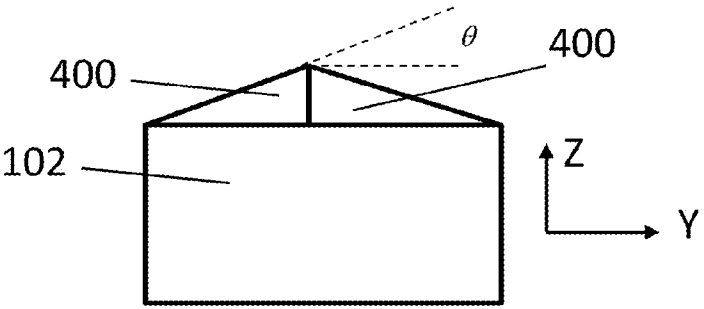

In other implementations, each element 104 of outer layer 102 includes one or more facets raised at different oblique angles from one another to give the surface of the outer layer 102 a raised appearance. Each facet is a planar portion of the exposed surface of the outer layer and is oriented at a different angle from adjacent facets within a particular element 104. By orienting the facets at different angles, light reflected off the facets will be redirected in different directions enhancing the reflectance of the jewel-shaped elements 104. FIG. 4 is a schematic illustrating a top (FIG. 4A) and two side-views (FIGS. 4B, 4C) of an element 104 including multiple facets 400. In the example of FIG. 4, the element 104 includes 4 facets creating a square pyramid-like shape. The facets 400 are arranged at different angles Θ with respect to a plane that is parallel to the x-axis and the y-axis, such that each facet is at an oblique angle with respect to at least one other facet. It should be noted that facets are shown with respect to the x-y plane for ease of viewing. In an implemented device, the outer layer would be curved to follow the curvature of the portion of the shoe corresponding to the upper. Though the element 104 shown in FIG. 4 is divided into 4 separate facets, the element 104 may be composed of different numbers of facets including, for example, 1 facet, 2 facets, 6 facets, or 8 facets. The facets may be formed from the layer 102 using manufacturing techniques such as injection molding, compression molding, and/or extrusion. The fabrication of the facets on the surface of the outer layer can result in the formation of grooves, as explained above, that separate the elements 104 from one another.

The outer layer 102 having the jewel-shaped elements 104 can be applied to any type of shoe including, for example, boots, dress shoes, flats, running shoes, skates (e.g., ice skates or roller skates), among others. Typically, a shoe is composed of separate parts known as an "upper" and a "sole." The upper refers to the part or parts of the shoe that cover the toes, the top of the foot, the sides of the foot, the back of the heel, and/or the legs. In reference to roller skates or ice skates, the upper may also be called "the boot." The upper is attached to the sole, which forms the bottom of the shoe. Depending on the style of the shoe (e.g., athletic shoe, boot, heel, dress, skates, etc.) the upper of the shoe can be cut from a single piece or can be composed of several pieces stitched together. Part of the shoe's upper can include, for example, the vamp, the back, the tongue, the quarter, and the lining. In some implementations, the outer layer 102 forms the entire outer surface of the upper, i.e., the surface that faces away from an inner element of the shoe where the foot is positioned. In other implementations, the outer layer 102 forms only a portion of the upper such as, for example, the tongue, the quarter, the vamp, the back, or combinations thereof. The remaining exterior portions of the shoe upper that are not formed from layer 102 can include standard fabric materials used to form shoes, such as natural leather, artificial leather, composite leather, woven fabrics (e.g., cotton), polyester, rubber, fake fur, among other materials. In general, the outer layer 102 and the optional additional fabric material are affixed to the interior lining of the shoe.

In some implementations, a light source is incorporated into the shoe to enhance the brilliance of the jewel-shaped elements of the outer layer. For example, the shoe can include one or more light sources, such as light-emitting diodes (LEDs), situated at various locations on the shoe and beneath the outer layer 102. When the light sources are activated, light is emitted and passes through the transparent or translucent outer layer 102. The light sources may be configured to emit a single color/wavelength (e.g., red, blue, or green) or a range of wavelengths (e.g., white light). Combinations of white light and/or different color light sources may also be used. In some implementations, e.g., when the jewel-shaped elements 104 include raised facets, the light emitted from a single light source is refracted by the different facets along different directions, giving rise to an impression of multiple light sources being embedded at a particular location in the shoe.

Figure 5:
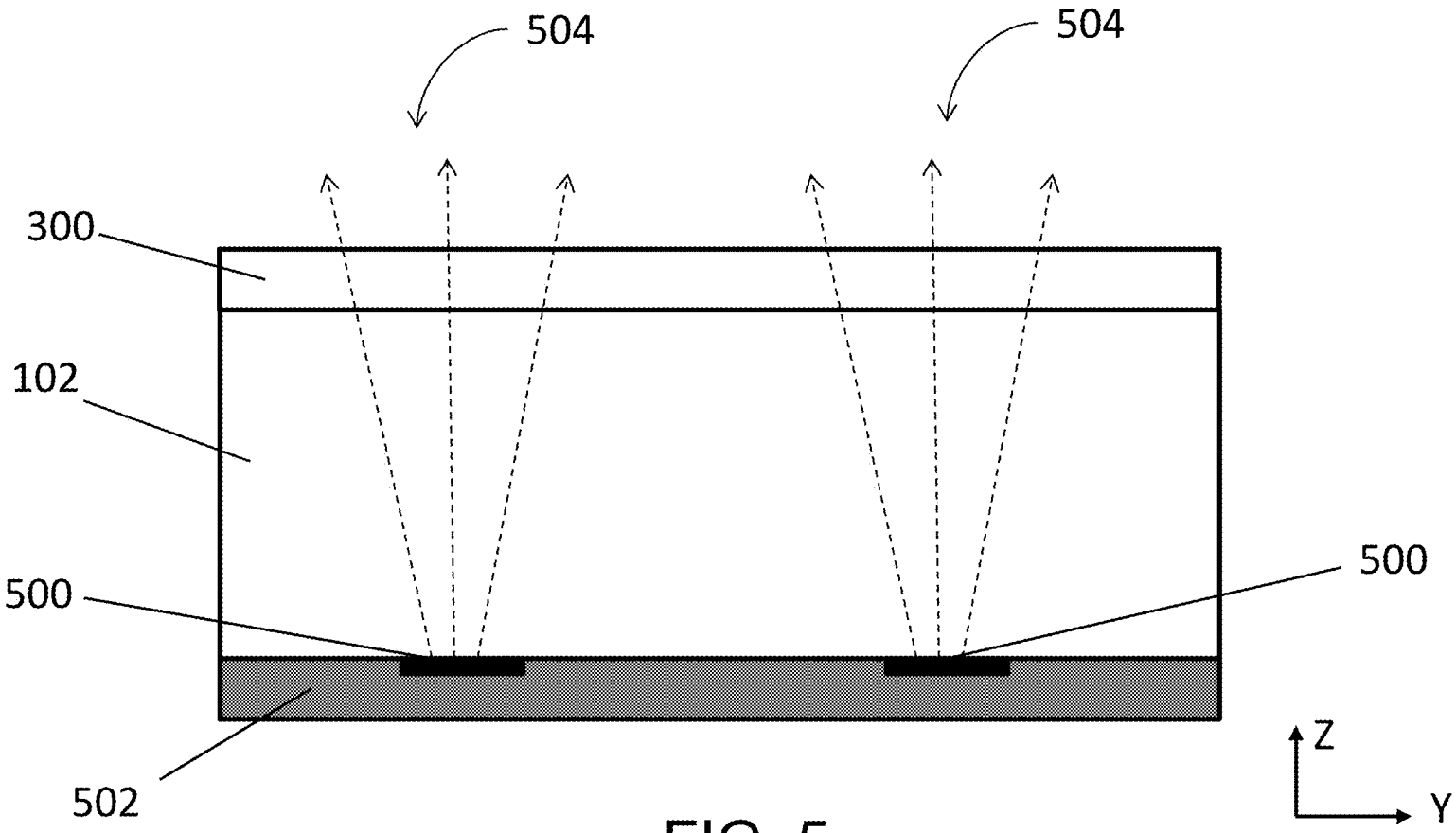
FIG. 5 is a schematic illustrating a side-view of a decorative outer layer beneath which a light emitting source is positioned.

FIG. 5 is a side-view of an outer layer 102 beneath which a light emitting source 500 (e.g., a LED) is positioned. The light source 500 is arranged on or embedded in a base 502 (e.g., a padding layer such as the interior lining). When the light source 500 is embedded in the base 502 (e.g., embedded in a cavity or depression in the base 502), the outer layer 102 forms a cover over the light source 500, such that the outer layer 102 and the base 502 form a housing for the light source. The top surface of the light source facing the outer layer 102 emits light 504, such that the light 504 travels through the transparent or translucent outer layer 102. The outer layer 102 may also include a semitransparent film 300 on its surface having a pattern (e.g., a diamond overspread pattern).

Figure 6A:
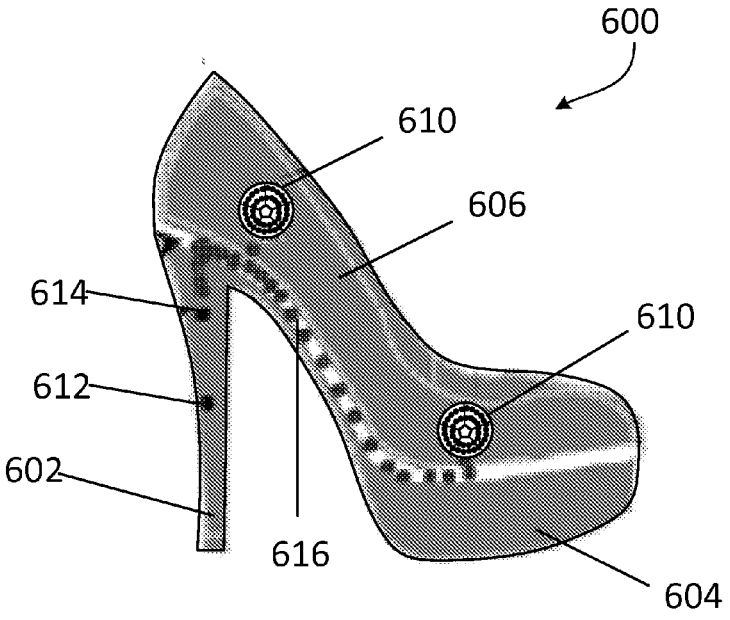
FIG. 6A is a schematic illustrating an example of a shoe in which light sources are affixed to the upper part.
Figure 6B:
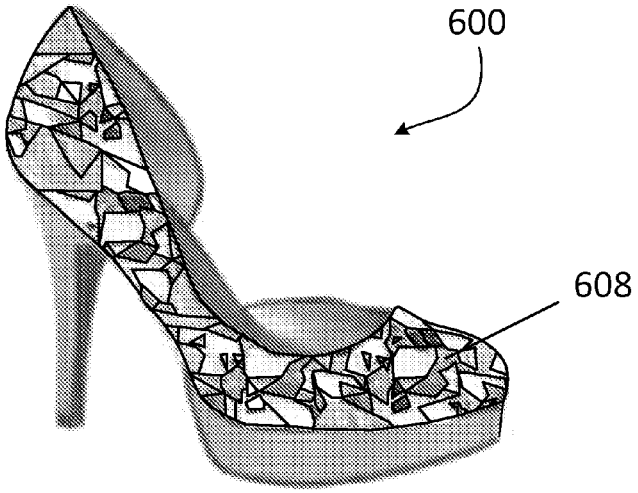
FIG. 6B is a schematic illustrating the example shoe of FIG. 6A after a decorative outer layer is applied to the shoe.

The light source may be located at various different positions of the shoe. For example, FIG. 6A is a schematic illustrating an example of a shoe 600 that includes a heel 602, a platform 604 and an upper 606 without an outer layer. FIG. 6B is a schematic illustrating the shoe 600 with the outer layer 608 in place on the upper 606. As shown in FIG. 6A, two light sources 610 are arranged on the upper 606 so that when the outer layer 608 is formed on the upper, the outer layer 608 hides the light sources 610 from direct view. The light sources 610 are coupled to a switch 612 and power source 614 (e.g., a battery) through one or more wires 616. Both the wires 616 and power source 614 are hidden from view within the shoe 600. For example, the power source wires 616 may be thread through the region between the platform 604 and the upper 606. The power source 614 may be arranged inside an opening in the heel 602. When activated, the switch 612 allows the light sources 610 to be activated with power from the power source 614. The switch 612 can include switches that are configured to be activated by hand. For example, the switch 612 may include a toggle that one can depress or move to different positions to change between a closed and open state for the circuit formed by the power source 614 and the light source 610. The switch 612 also may be positioned on the heel 602. The switch can be configured to blend into the surface of the heel 602 (e.g., by having the same color as the heel itself) so as not to draw attention to the switch 612.

Figure 6C:
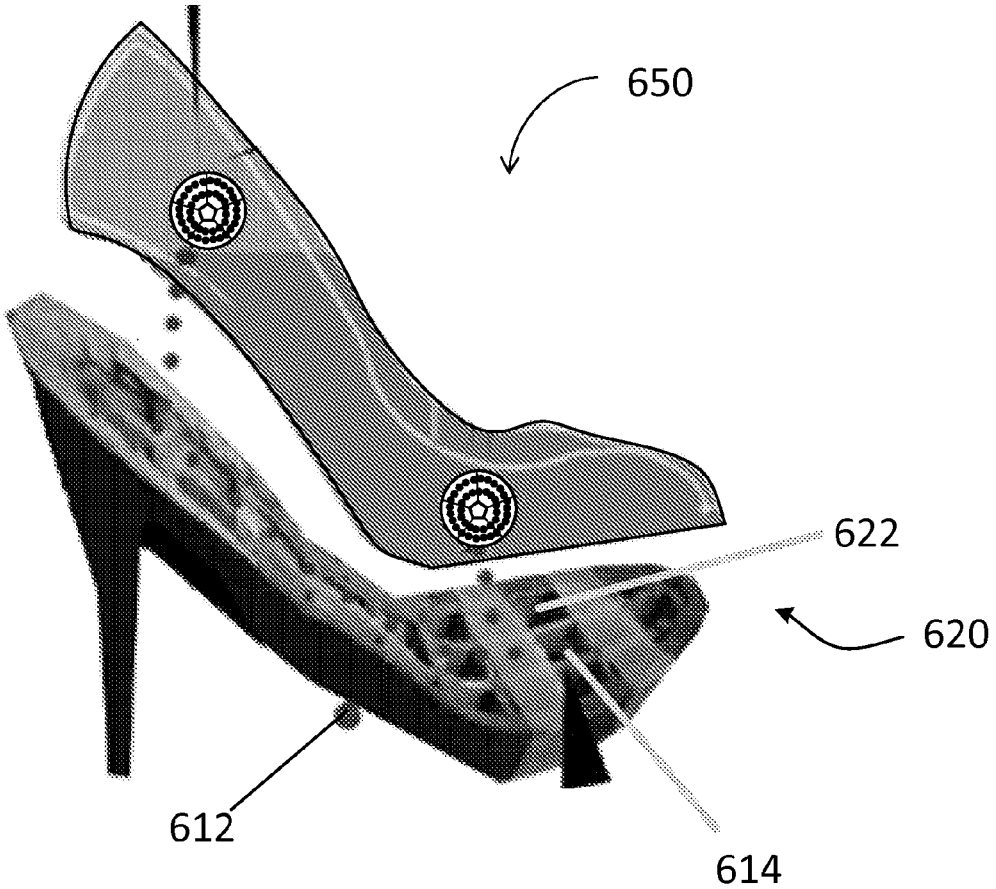
FIG. 6C is a schematic illustrating an example of a shoe separated into the upper and lower parts, in which light sources are affixed to the upper part.

Other configurations of the power source 614 and switch 612 also are possible. For example, in some implementations, the power source 614 can be embedded within the platform 604. FIG. 6C is a schematic illustrating an example of a shoe 650 in which the power source 614 is embedded in a mid-sole 620. The mid-sole 620 includes one or more openings 622 configured and sized to receive the power source 614. The portions of the mid-sole 620 surrounding the openings for the power source may be formed to have hard plastic walls to provide protection of the power source 614 and for stability. In the implementation shown in FIG. 6C, the switch 612 may be placed on the bottom of the shoe sole out of view when a user walks with the shoe 650 on.

Figure 6D:
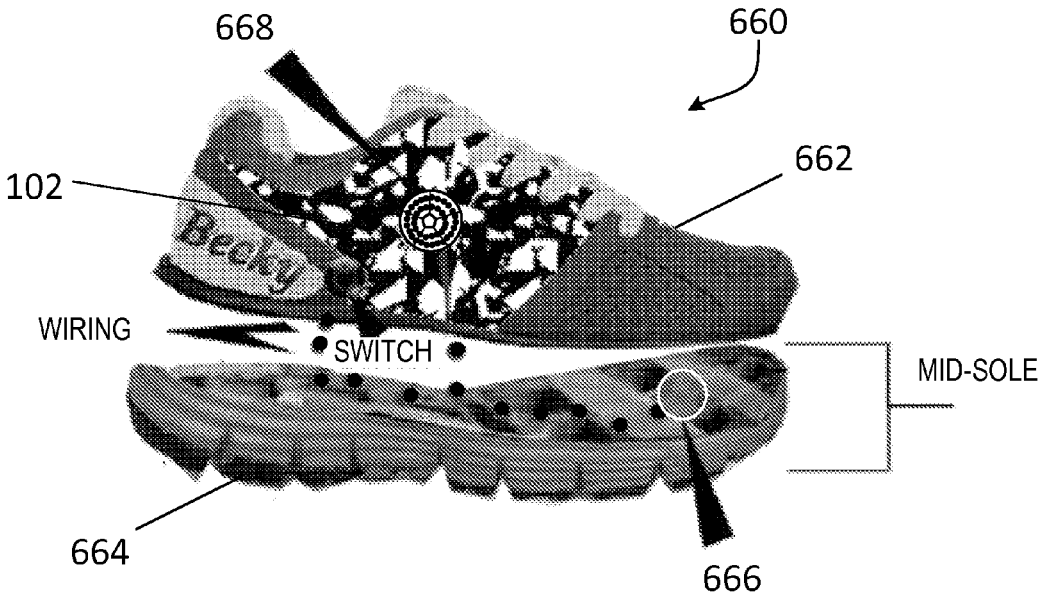
FIGS. 6D-6E are schematics illustrating examples of a sneaker.
Figure 6E:
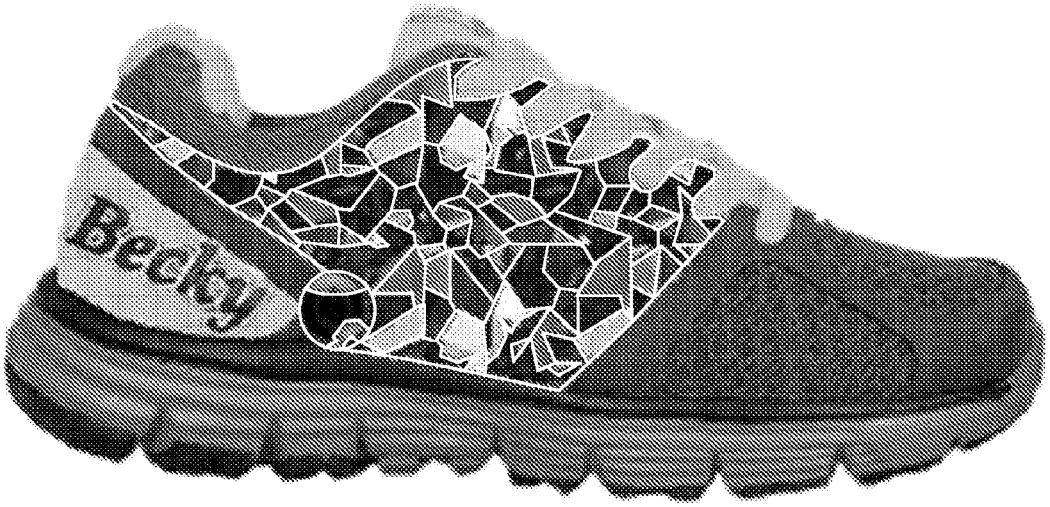

Other shoe types also may be incorporate an outer layer, such as layer 102, and one or more light sources located beneath the outer layer. For example, FIGS. 6D and 6E are schematics illustrating an example of a sneaker 660. FIG. 6D shows the upper 662 of the sneaker 660 separated from the sole 664, in which a power source (e.g., battery) 666 is embedded. The power source is electrically coupled to one or more light sources 668 positioned beneath an outer layer 102 using wiring 661. A switch (e.g., a push-button, labeled "switch") may be positioned on the outer layer 102, allowing a user to turn the light source(s) 668 on and off by depressing the switch. FIG. 6E illustrates the upper joined to the sole 664.

In some implementations, the outer layer having the jewel-shaped elements also can include a protrusion on which the shoe can be customized by the user. For example, the protrusion provides a region on which a user can apply their own signature (e.g., using any suitable writing instrument such as a permanent marker) or any desired pattern. When one or more light sources are embedded within the shoe, the light sources can illuminate the features located on the protrusion given the transparency/translucence of the material forming the outer layer.

Figure 7A:
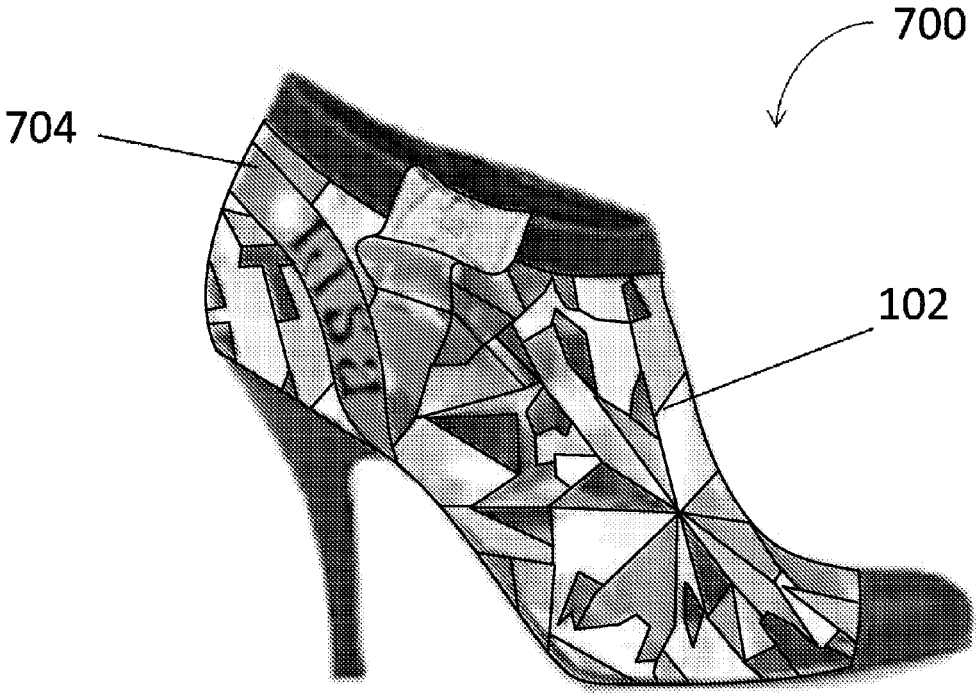
FIGS. 7A-7B are schematics illustrating examples of shoes having protrusions formed in an decorative outer layer.

FIG. 7A is a schematic illustrating an example of a shoe 700 having a protrusion 704 formed in an decorative outer layer 102. The decorative outer layer 102 also contains an area having jewel-shaped elements as described above. The protrusion 704 is an elongated mesa-like shape having a substantially planar top face. Though substantially planar, the protrusion 704 may have some curvature to conform to the shape of the shoe. As a protrusion, the height of the area protrusion extends beyond the average height of other areas of the outer layer, e.g., the areas containing the jewel-shaped elements. The protrusion 704 is contiguously formed with the material constituting the outer layer 102 and is not a separate piece attached to the outer layer 102. In some implementations, the protrusion 704 can be differentiated from the other portions of the outer layer 102 by tinting the protrusion 704 a different color. For example, the protrusion 704 can be tinted red, whereas the remaining areas of the outer layer 102 can be tinted blue. The protrusion 704 can be formed using the same molding process used to establish the different jewel-shaped elements of the outer layer 102. The height of the protrusion 704, as measured from the top surface of outer layer 102, can range from about 0.5 mm to about 13 mm. The area of the protrusion surface may be in the range of, for example, about 144 $mm^2$ to about 7000 $mm^2$. In some implementations, the length of the protrusion 704 extends from the toe of the shoe to the heel of the shoe.

Figure 7B:
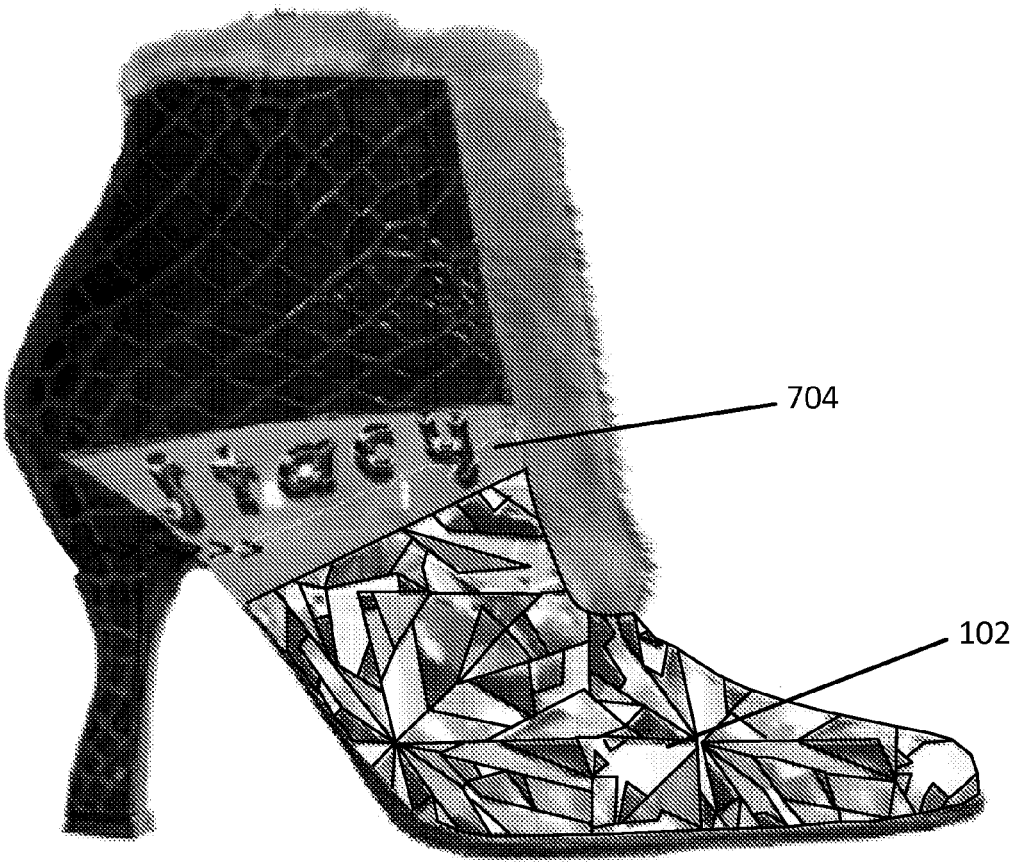

The design to be formed on the protrusion may be fabricated on a transfer sheet (e.g., printed on an adhesive transfer sheet or heat transfer sheet) having about the same are as the planar surface of the protrusion. Using, e.g., a heat press, the design may be affixed to the protrusion. FIG. 7B is a schematic illustrating another example of a shoe containing an outer layer 102 having jewel-shaped elements and a protrusion 704 on which a user has affixed a design in the form of a name (i.e., "Stacy"). Other portions of the shoe contain other fabrics, such as leather or fake fur.

Figure 8A:
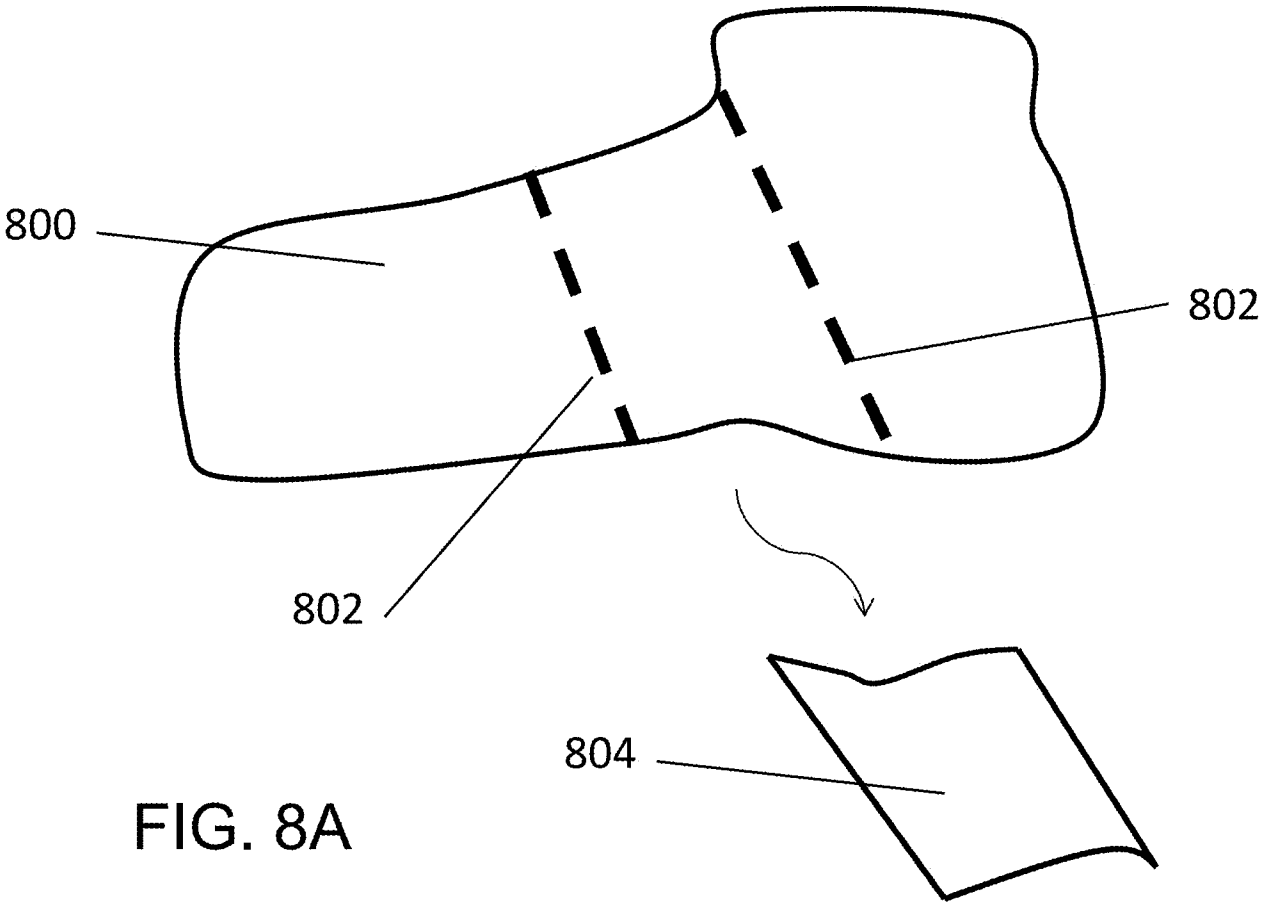
FIGS. 8A-8I are schematics illustrating an example series of fabrication techniques for preparing a shoe having a decorative outer layer.

The following paragraphs describe the fabrication process for preparing a decorative shoe, as disclosed herein. Upon selecting the type of shoe (e.g., boot, running shoe, dress shoes, etc.), a shoe last is provided for the selected shoe. A last is a mechanical form that has a shape similar to that of a human foot. A last is used by shoemakers in the manufacture and repair of shoes. A different last is used for each different shoe size and type. Once the shoe type and last are selected, the area of the shoe intended to include the decorative outer layer is designated, e.g., by marking the last. The marked area denotes the specific region for placement of the decorative outer layer. For example, the selected region of the last may correspond to the heel, the upper, the toe, or combinations thereof. Any suitable method of marking can be used. For example, in some implementations, the last can be covered in masking tape to identify the regions of the shoe to include the decorative outer layer. Alternatively, the regions can be marked with a writing element such as a pen or pencil. FIG. 8A is a schematic of a last 800 that has been marked with dashed lines 802, where the area between the lines indicates the region on which the decorative outer layer will be formed. After marking the desired regions, the outlines of the marked areas on the last are copied to one or more separate sheets 804, e.g., paper or cardboard, that will be used later in the fabrication process to establish the size and shape of the transfer pattern to be applied to the outer layer.

Figure 8B:
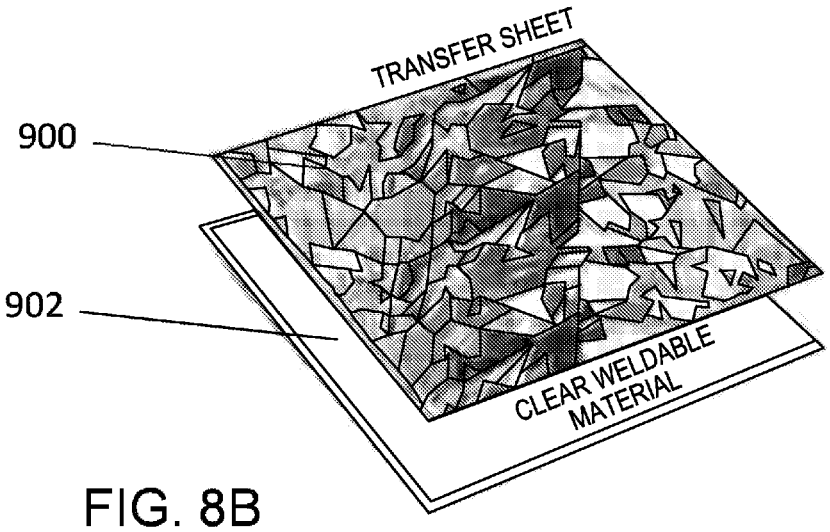
Figure 8C:
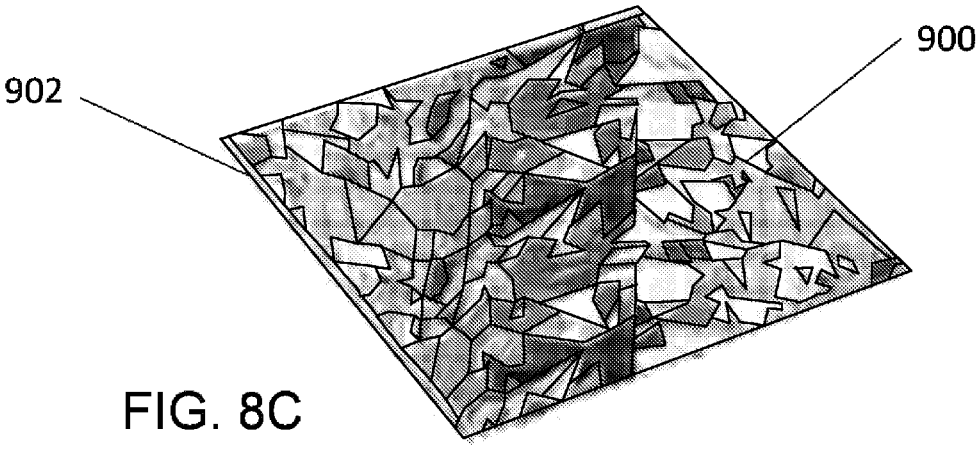

As explained above, the semitransparent transfer pattern, e.g., the diamond overspread pattern, is designed CAD software and then copied, e.g., printed, to a transfer sheet, such as an adhesive transfer sheet or heat transfer sheet. With the pattern printed on the transfer sheet, the transfer pattern may be transferred to a moldable plastic material, e.g., PMMA. For example, FIG. 8B is a schematic illustrating an example of a transfer sheet 900 containing the transfer pattern (e.g., a diamond overspread pattern) prior to applying the pattern to a moldable plastic layer 902. An example technique for transferring the semitransparent pattern to the layer 902 includes using a heat transfer process. In a heat transfer process, the transfer sheet having the pattern is placed on top of the layer 902. The transfer sheet 900 and plastic layer 902 then are placed in a heat press, which applies heat to the transfer sheet 900 so that the pattern adheres to the plastic layer 902. The transparent plastic backing of the transfer sheet 900 then is peeled away and the pattern film remains fixed to the layer 902. FIG. 8C is a schematic illustrating a moldable plastic layer 902 containing the pattern (e.g., the diamond overspread pattern) after the transfer process. The plastic layer 902 containing the pattern is used as the decorative outer layer for the shoe. As an alternative to using a heat press, in some implementations, the pattern can be transferred to the layer 902 as an adhesive. For example, one side of the EVA or PVC layer on the transfer sheet 900 may have a thin film of glue or adhesive epoxy. The side containing the adhesive is placed on the layer 902, after which pressure is applied to the transfer sheet to bind the transfer pattern to the layer 902. The transparent backing sheet then is peeled away from the transferred pattern, which remains fixed to the layer 902.

Figure 8D:
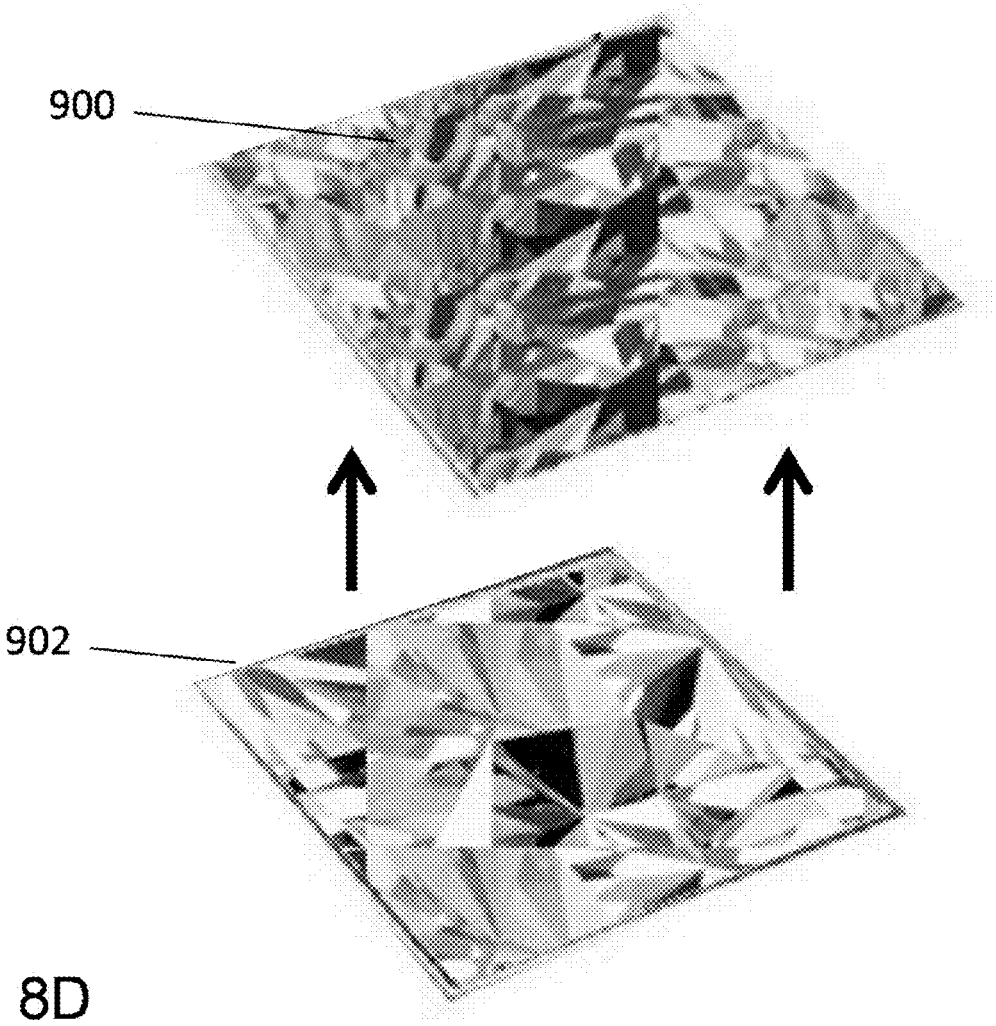

In some implementations, the moldable plastic layer 902 includes jewel-shaped elements pre-formed on its surface prior to applying the semi-transparent film. For example, the jewel-shaped elements may correspond to multiple thin planar facets delineated by grooves (see FIG. 2) or may include raised facets (see FIG. 4). The jewel-shaped elements may be formed on the outer layer using a suitable molding process such as injection molding, compression molding and extrusion. As shown in FIG. 8D, a semitransparent film 900 having a design pattern is applied to the moldable plastic layer 902 (e.g., PMMA) which includes protrusions in the shape of jewel-shaped elements.

Alternatively, or in addition, a dielectric mirror stack may be formed on the top surface of the outer layer 902. As explained above, the dielectric mirrors may be manufactured using common thin-film deposition methods, such as physical vapor deposition, chemical vapor deposition, ion beam deposition, molecular beam epitaxy, and sputter deposition of the dielectric stack onto the plastic outer layer 102. In some implementations, the outer layer 902 is molded to include a protrusion that is an elongated mesa-like shape having a substantially planar top face, as described above with respect to FIG. 7A.

Figure 8E:
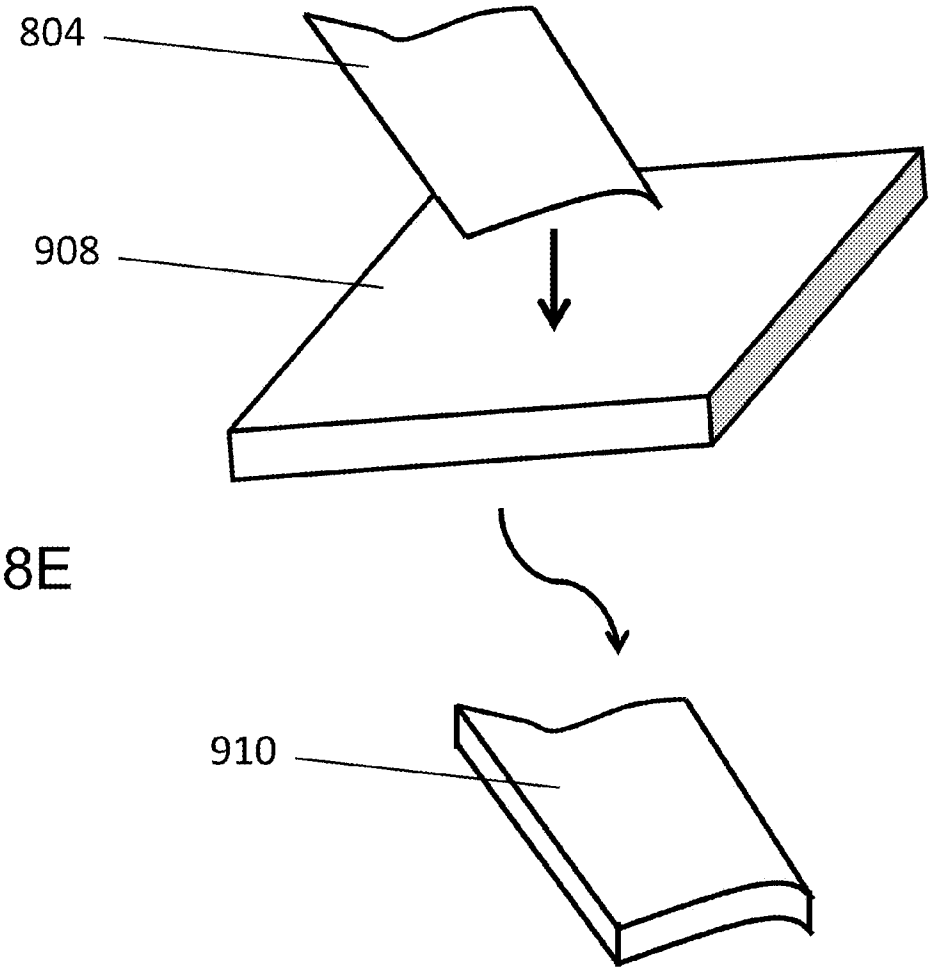

The sheets 804 defining the outline of the area to be covered with the decorative outer layer 902 then are placed on a cushioned padding material 908 that will function as the interior lining (see FIG. 8E). The cushioned padding material 908 is cut along the outline of the sheets 804 and forms the base 910 on which the decorative outer layer 902 will be fixed. Depending on the areas of the shoe to be covered with the decorative outer layer 902, the cut pieces of padding material 908 may be stitched together. For example, cut padding pieces 910 may be stitched together to form the upper part of the shoe containing the toe and heal sections.

Figure 8F:
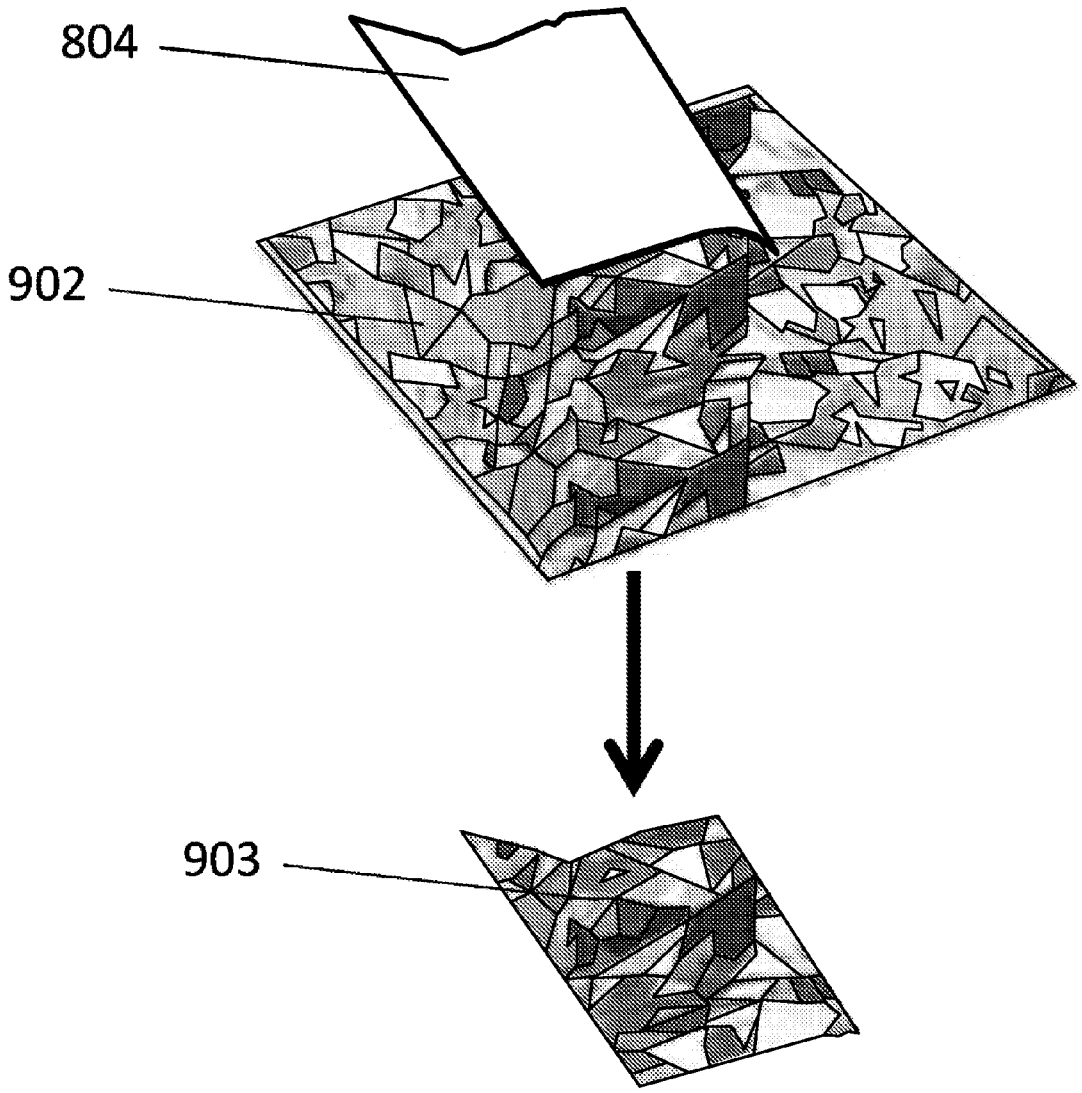
Figure 8G:
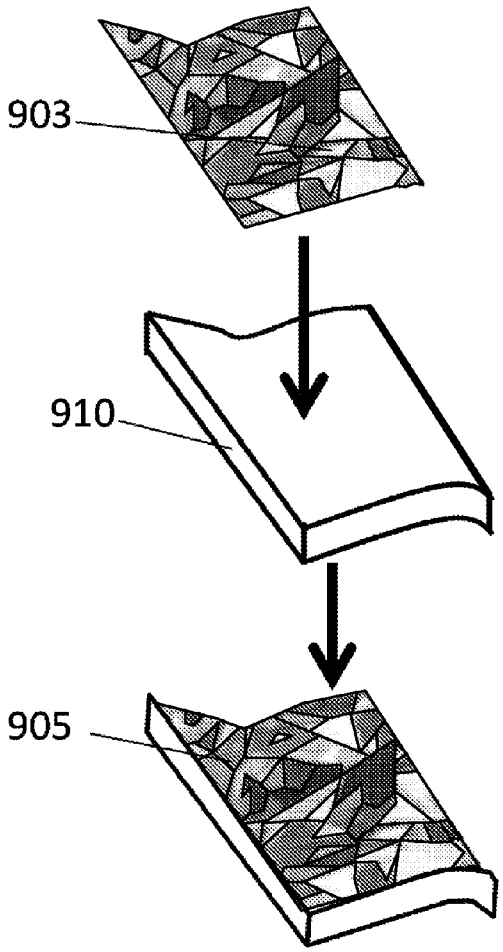
Figure 8H:
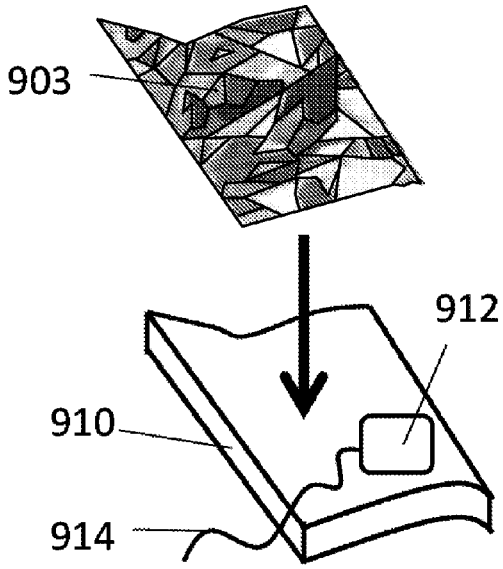

The decorative outer layer 902 (which may include the semitransparent film or other reflective/partially reflective layer) also is cut into the same shape as the one or more sheets 804 (see FIG. 8F) to form individual decorative outer layer pieces 903. The individual decorative outer layer pieces 903 then are fixed to the padding pieces 910 (e.g., the interior lining) of the same shape using, e.g., an adhesive such as glue or epoxy to form a padding-outer layer stack 905 (see FIG. 8G). In some implementations, when a light source 912 (e.g., LED) is used, the light source 912 is fixed (e.g., using glue or epoxy) on the surface of the padding pieces 910 or within cavities in the padding pieces 910 that are configured to hold the light source 912 prior to affixing the decorative outer layer pieces 903 to the padding piece 910 (see FIG. 8H). A wire 914 connected to the light source may extend over the edge of the padding 910 for connection to the power supply when the shoe is fully constructed. Alternatively, or in addition, a thin film reflective layer (e.g., reflective foil) may be affixed (e.g., using glue or epoxy) to the top surface of the padding layer between the padding layer and the decorative outer layer. If a light source is used, the reflective foil is positioned beneath the light source.

Figure 8I:
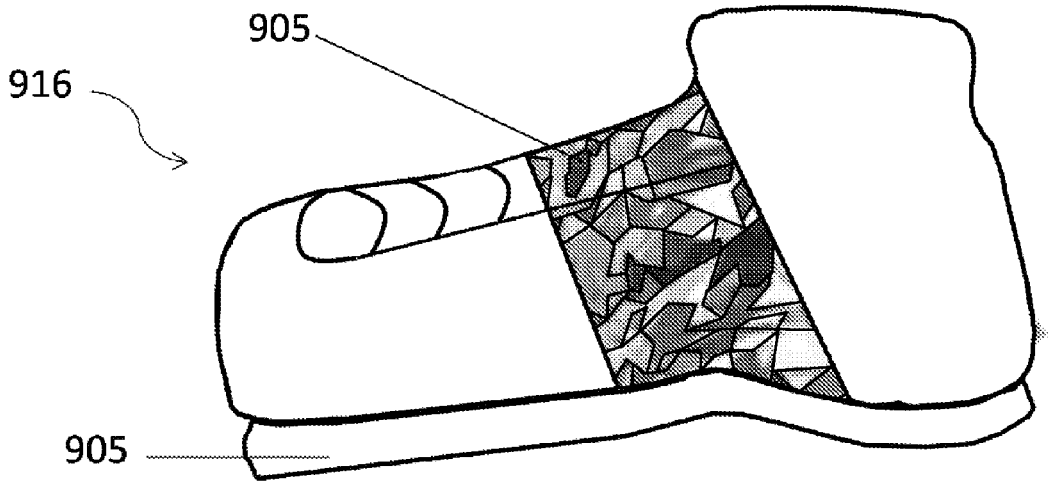

With the padding-decorative outer layer 905 stack formed, the stack 905 and the remaining parts of the shoe that will not include the decorative outer layer (e.g., leather, polyester, or other fabric) then are placed onto the last and stitched together. For example, the padding of stack 905 may be stitched together with other fabric to form the shoe upper 916. An adhesive then is applied to the upper and to a sole 918 for bonding the sole and upper together. The sole is attached to the upper and then compressed to secure the bonding of the parts together (see FIG. 8I).

A number of implementations of the invention have been described. Nevertheless, it will be understood that various modifications may be made without departing from the spirit and scope of the invention. Other implementations are within the scope of the following claims.

What is claimed is:

1. A decorative shoe comprising:

a sole;

an upper attached to the sole, wherein the upper comprises an interior lining, a decorative outer layer fixed to the interior lining, the decorative outer layer being composed of a contiguous transparent or translucent plastic material, wherein a surface of the decorative outer layer comprises a first plurality of raised, close-packed jewel-shaped elements, and a fixed to the surface of the decorative outer layer, and wherein the decorative semi-transparent pattern film simulates an appearance of a plurality of jewels, wherein each jewel-shaped element has a short axis and a plurality of boundaries extending along directions normal to the short axis, the plurality of boundaries enclosing one or more facets on a face of the jewel-shaped element, wherein the semi-transparent pattern film forms an outer surface of the shoe and is configured to partially reflect or scatter incident light, and wherein the surface of the decorative outer layer comprises an elongated mesa-like protrusion having a substantially planar top face.

2. The decorative shoe of claim 1, wherein the decorative outer layer exhibits a tint of at least one color.

3. The decorative shoe of claim 1, wherein the decorative pattern film comprises a second plurality of close-packed jewel-shaped elements.

4. The decorative shoe of claim 3, wherein at least one of the jewel-shaped elements of the second plurality of close-packed jewel-shaped elements exhibits different colors.

5. The decorative shoe of claim 1, wherein the decorative shoe comprises a boot, a dress shoe, a flat, a running shoe, an ice skate, or a roller skate.

6. The decorative shoe of claim 1, wherein each of the first plurality of close-packed jewel-shaped elements is approximately equal in size.

7. The decorative shoe of claim 1, wherein one or more of the first plurality of jewel-shaped elements have at least two boundaries of differing lengths.

8. The decorative shoe of claim 1, wherein each boundary of each jewel-shaped element is greater than about ¼ mm and less than about 76 mm.

9. The decorative shoe of claim 1, wherein the upper further comprises a reflective layer between the decorative outer layer and the interior lining or between the decorative outer layer and the semi-transparent pattern film, wherein the reflective layer is configured to have a reflectance of at least about 85%.

10. The decorative shoe of claim 9, wherein the reflective layer is a metal foil.

11. The decorative shoe of claim 1, wherein the decorative outer layer is polymethyl methacrylate (PMMA).

12. The decorative shoe of claim 1, wherein the elongated mesa protrusion having a substantially planar top face has a surface area between about 144 $mm^2$ to about 7000 $mm^2$.

13. The decorative shoe of claim 12, wherein the elongated mesa protrusion has a length between about 1 to 12 inches, a width between about 0.5 to 3 inches, and a protrusion thickness between about 0.1 to 0.5 inches.

14. The decorative shoe of claim 1, wherein the decorative outer layer covers an entire first surface of the upper, wherein the first surface faces outward from an interior region of the shoe.

15. The decorative shoe of claim 1, wherein the face of each jewel-shaped element is smooth.

16. The decorative shoe of claim 1, wherein each jewel-shaped element in the first plurality of close-packed jewel-shaped elements comprises a plurality of facets, each facet being raised at an oblique angle from at least one other facet in the jewel-shaped element.

17. The decorative shoe of claim 1, wherein the boundaries of each jewel-shaped element are grooves.

18. The decorative shoe of claim 1, further comprising:

a power source;

one or more light emitting devices electrically coupled to the power source, and arranged between the interior lining and the decorative outer layer.

19. The decorative shoe of claim 18, wherein the one or more light emitting devices include a white light emitting diode.

20. The decorative shoe of claim 18, wherein the power source is embedded in the sole of the shoe.

21. The decorative shoe of claim 18, comprising one or more housings, wherein the one or more light emitting devices are embedded in the one or more respective housings, and wherein the interior lining forms sidewalls to the housings, and the decorative outer layer forms a cover of the one or more housings.

22. The decorative shoe of claim 1, wherein an outer surface of the decorative outer layer is planar across the first plurality of raised, close-packed jewel-shaped elements, the entire outer surface of the decorative outer layer facing away from an interior region of the shoe.

23. The decorative shoe of claim 1, further comprising a fabric attached to the decorative outer layer and forming a portion of the shoe exterior, wherein the fabric is selected from the group consisting of natural leather, artificial leather, composite leather, cotton, polyester, rubber, fake fur, and combinations thereof.

24. A decorative shoe comprising:

a sole;

an upper attached to the sole, wherein the upper comprises an interior lining, a decorative outer layer fixed to the interior lining, the decorative outer layer being composed of a contiguous transparent or translucent plastic material, wherein a surface of the decorative outer layer comprises a first plurality of close-packed raised jewel-shaped elements, each jewel-shaped element being configured to simulate an appearance of a jewel, and wherein each jewel-shaped element in the first plurality of close-packed jewel-shaped elements has a short axis and a plurality of boundaries normal to the short axis, the plurality of boundaries enclosing a plurality of facets on a face of the jewel-shaped element, each facet being raised at an oblique angle from at least one other facet in the jewel-shaped element, wherein each jewel-shaped element is configured to partially reflect or scatter incident light, and wherein the surface of the decorative outer layer comprises an elongated mesa-protrusion having a substantially planar top face.

* * * * *

UNITED STATES PATENT AND TRADEMARK OFFICE

CERTIFICATE OF CORRECTION

PATENT NO. : 9,320,321 B2
APPLICATION NO. : 14/201596
DATED : April 26, 2016
INVENTOR(S) : Carl Robinson, Jr.

It is certified that error appears in the above-identified patent and that said Letters Patent is hereby corrected as shown below:

In the Claims

In Column 11, Line 61, in Claim 1: delete “mesa-like” and insert -- mesa --, therefor.

In Column 13, Line 28, in Claim 24: delete “mesa-protrusion” and insert -- mesa protrusion --, therefor.

Signed and Sealed this
Fifth Day of July, 2016

Michelle K. Lee

Michelle K. Lee
*Director of the United States Patent and Trademark Office*